US005283922A

United States Patent [19]

Ruprecht

[11] Patent Number: 5,283,922

[45] Date of Patent: Feb. 8, 1994

[54] PIPE CLEANING TOOL

[75] Inventor: Gustl W. Ruprecht, Ranstadt, Fed. Rep. of Germany

[73] Assignee: Horst K Lunder GmbH, Nidda, Fed. Rep. of Germany

[21] Appl. No.: 939,691

[22] Filed: Sep. 2, 1992

[51] Int. Cl.[5] ..... B08B 9/02

[52] U.S. Cl. ..... 15/104.33

[58] Field of Search ..... 15/104.33, 339; 200/61.85; 254/134.3 FT

[56] References Cited

U.S. PATENT DOCUMENTS

| | | | |
|---|---|---|---|
| 2,266,659 | 12/1941 | Robinson | 15/104.33 |
| 2,705,642 | 4/1955 | Chasar | 15/104.33 |
| 3,075,217 | 1/1963 | Kollmann | 15/104.33 |
| 3,159,861 | 12/1964 | Sarcone | 15/104.33 |
| 3,213,473 | 10/1965 | Singer | 15/104.33 |
| 3,855,665 | 12/1974 | Schwartz | 15/339 |
| 4,188,683 | 2/1980 | Klunder | 15/104.33 |

*Primary Examiner*—Edward L. Roberts
*Attorney, Agent, or Firm*—Michael D. Bednarek

[57] ABSTRACT

A pipe cleaning machine for driving a pipe cleaning coil. The pipe cleaning machine includes a hand lever having a switch which can be used by the operator to both engage the drive and to change the direction of rotation.

3 Claims, 1 Drawing Sheet

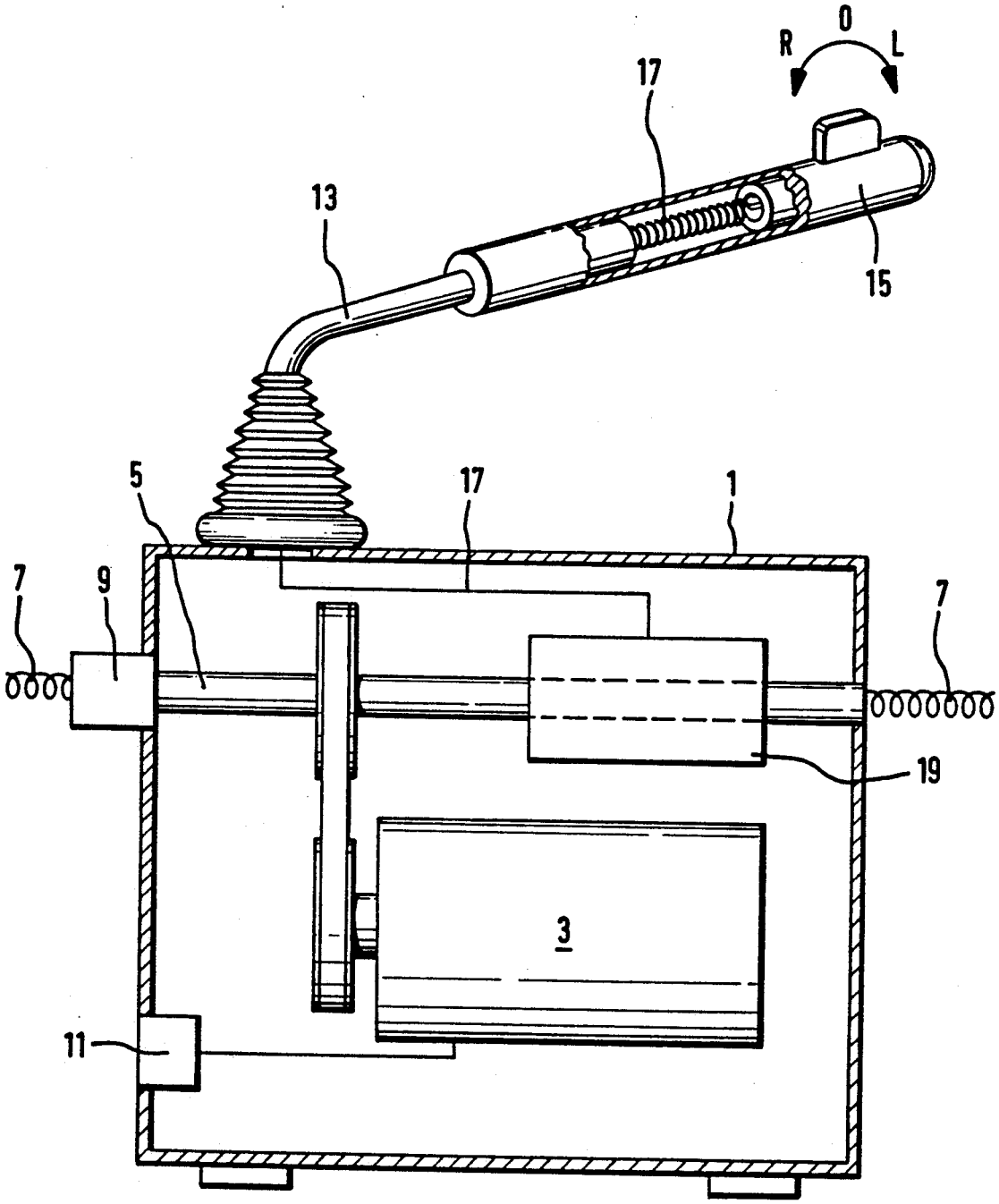
R
0
L
17
13
15
5
17
1
7
9
7
19
3
11

PIPE CLEANING TOOL

FIELD OF THE INVENTION

The invention concerns a pipe cleaning machine for driving a pipe cleaning coil. Such machines include a pipe shaft assembly which includes a drive housing unit rotating pipe shaft that runs through the housing unit for the insertion of the pipe cleaning coil. The pipe shaft is driven by an electric motor which has a changeable turning direction and a controller for switching on the drive and for changing to either of the available directions. The pipe shaft assembly is designed with a clamp mechanism for the temporary stable coupling of the pipe shaft with the pipe cleaning coil in a temporary conveyance position whereby rotation of the pipe shaft is imparted to the pipe cleaning coil. A hand lever on the top of the drive housing unit is provided for the user's operation.

BACKGROUND OF THE INVENTION

Existing portable pipe cleaning machines (see, e.g., U.S. Pat. No. 4,188,683) have a drive power unit that is provided with a powered pipe shaft. Through this pipe shaft, a pipe cleaning coil will be inserted. Above and beyond that, these machines contain a clamp mechanism that is attached to the pipe shaft for the temporary stable coupling of the pipe shaft with the pipe cleaning coil in a temporary conveyance position; i.e. a position in which rotation is conveyed or transmitted to the pipe cleaning coil. A hand lever on the top of the drive housing unit is provided for the operation of the clamp mechanism for temporarily coupling the pipe shaft with the pipe cleaning coil. The hand lever is operated by one of the operator's hands during use.

The front end of the pipe cleaning coil is equipped with a tool designed to hit an obstruction present in a pipe or canal. In operation, when the tool hits an obstruction, the pipe cleaning coil is turned to the right or left in constant alteration to allow a further intrusion of the tool on the pipe cleaning coil against the obstruction. Heretofore, the changeable shifting of the turning direction of the pipe cleaning coil was achieved through the use of a switch that was affixed to the back of the housing unit for the power unit. In that situation, the switch was located outside of the real field of activity, namely on the back of the pipe cleaning machine in a position hard for the operator to reach. Because the operator must constantly lead the pipe cleaning coil with one hand out of the pipe shaft, in order to push the pipe cleaning coil into the pipe to be cleaned, and with the other hand must push the hand lever, every time the switch had to be touched the work procedure was interrupted. This was inconvenient and time consuming.

SUMMARY OF THE INVENTION

The present invention provides a hand-held directional switch made for pipe cleaning machines so as to improve the serviceability of such machines, to make them safer, and to facilitate their operation.

In accordance with the present invention, both the switch for the activation of the drive and the switch for reversing the direction of the drive are contained in the hand lever.

Current for the motor is supplied through the operating main switch unit through a low voltage switch unit. The switch in the hand grip in the hand lever is a low voltage switch with which the low voltage switch unit is operable.

The main switch unit could additionally be operated from a hand operated main switch that is located on the side of the drive house, preferably located on the back.

The operator of the pipe cleaning machine must constantly push the hand lever down to engage the pipe cleaning coil with the clamp mechanism so as to set the coil in rotation. Because of this, it is especially advantageous if now on that same hand lever the Right-Neutral-Left functions could be engaged without having to release the hand lever or engaging a switch that lies outside of the work area. Accordingly, the operator has one hand free to operate the hand lever together with the switch to control the rotational direction and the other hand to feed forward the pipe cleaning coil. A further advantage is that an electronic guiding mechanism can be accommodated inside of the housing unit of the drive power unit. There it is protected from high mechanical stress, water penetration, overload and damage. This electronic guiding mechanism also makes it possible to operate the switch integrated into the hand lever with low voltage, for example with 24 Volts. This increases the protection against accidents greatly. Independent of this switch, a main switch can be set on the back of the unit that would be used only when the machine is to be shut off.

A working embodiment of the invention will now be described in detail closely illustrated with reference to the accompanying drawing.

BRIEF DESCRIPTION OF THE DRAWING

The sole drawing is a partially schematic partially perspective view of the pipe cleaning tool of the present invention.

DETAILED DESCRIPTION

The pipe cleaning machine shows a portable housing unit (1) that houses the drive power unit. The drive power unit comprises a pipe shaft (5) having an axial bore formed therethrough and extending axially through the housing unit. The shaft is driven by a motor (3). The motor (3) is preferably an electric motor. A pipe cleaning coil (7) extends through the pipe shaft (5). In the known manner, a tool which is designed to loosen or remove obstructions in a canal or pipe is attached on the lead end of the pipe tool (not shown).

On the back of the housing unit (1) of the pipe cleaning machine is a conventional clamp mechanism (9) connected to the pipe shaft (5) for the temporary stable coupling of the pipe shaft (5) with the pipe cleaning coil (7) in a temporary conveyance or rotation transmitting position. The drive power unit is engaged with or activated by a main switch (11). As described heretofore, the pipe cleaning machine is conventional.

On the top of the housing unit (1) of the pipe cleaning machine is a hand lever (13) through which an operator may press the clamp mechanism (9) via appropriate mechanical linkage (see, e.g., U.S. Pat. No. 4,188,683), either out of contact or in contact with the pipe cleaning coil (7) being fed into the pipe shaft (5). In accordance with the present invention, the hand lever (13) includes a switch (15), preferably a low voltage switch, that is attached through a cable (17) to an electronic low voltage switching unit (19) within the housing unit (1). The switching unit (19) is in turn operably connected to the electric motor (3) of the drive power unit.

The switch (15) is a Right-Neutral-Left switch and is operable, as is the electronic low voltage switching unit (19), with low voltage, for example 24 Volts. Such a low voltage switch and switching unit may be conventional (see, e.g., U.S. Pat. No. 3,855,665) and is often necessary to comply with government safety requirements.

If the operator presses the hand lever with one hand and with the other holds the pipe cleaning coil (7), to cause a contact of the clamp mechanism (9) with the pipe cleaning coil (7) and to push the pipe cleaning coil into the pipe to be cleaned, the switch (15) can be simultaneously placed in the desired right, left or neutral setting in order to determine the direction of revolution of the pipe cleaning coil. This switching occurs until the obstruction in a pipe or canal is loosened and is removed by the tool located on the tip of the pipe cleaning coil.

I claim:

1. A pipe cleaning machine for the operation of a pipe cleaning coil, the pipe cleaning machine comprising: a power unit having a housing; a rotating pipe shaft assembly comprising a hollow pipe shaft extending through the housing of the power unit, the pipe shaft being adapted for the insertion of the pipe cleaning coil therethrough; the power unit including an electric motor power drive unit for driving the pipe shaft with a changeable rotation direction; the pipe shaft assembly further including a clamp mechanism for the temporary stable coupling of the pipe shaft to the pipe cleaning coil in a temporary rotation transmitting position; a hand lever provided on the top of the power housing unit for operating the clamp mechanism wherein the hand lever includes a switch for engaging the electric power drive unit and for changing the rotation direction.

2. A pipe cleaning machine, as described in claim 1, further comprising an operating main switch unit provided for controlling the supply of motor current operating through a low voltage switch unit and whereby the switch provided in the hand lever is a low voltage switch for controlling the low voltage switch unit.

3. A pipe cleaning machine, as described in claim 2, wherein the main switch unit can also be operated by hand with a main switch that is located on the wall of the power unit housing.

* * * * *

UNITED STATES PATENT AND TRADEMARK OFFICE

CERTIFICATE OF CORRECTION

PATENT NO. : 5,283,922

DATED : February 8, 1994

INVENTOR(S) : Ruprecht

It is certified that error appears in the above-indentified patent and that said Letters Patent is hereby corrected as shown below:

On the Title Page Item [73] the spelling of the assignee is shown as "Horst K Lunder GmbH" and should be corrected to --Horst Klunder GmbH--.

Signed and Sealed this

Second Day of August, 1994

Bruce Lehman

*Attest:*

BRUCE LEHMAN

*Attesting Officer*

*Commissioner of Patents and Trademarks*